United States Patent [19]

Thompson

[11] Patent Number: 5,074,061

[45] Date of Patent: Dec. 24, 1991

[54] LAND ARRANGER

[76] Inventor: Warren H. Thompson, 418 S. Cramner, Conway Springs, Kans. 67031

[21] Appl. No.: 671,414

[22] Filed: Mar. 20, 1991

[51] Int. Cl.[5] ..... E02F 5/04

[52] U.S. Cl. ..... 37/129; 37/124; 172/196; 172/197

[58] Field of Search ..... 37/129, 131, 132, 138, 37/124, 4, 9, 126 R; 172/196, 197, 199, 784

[56] References Cited

U.S. PATENT DOCUMENTS

| | | | |
|---|---|---|---|
| 1,911,511 | 5/1933 | Jordan | 37/129 |
| 2,445,260 | 7/1948 | Brimhall | 37/129 |
| 2,483,033 | 9/1949 | Baker | 37/124 |
| 2,567,534 | 9/1951 | Whittier | 37/129 |
| 3,110,972 | 11/1963 | Waite | 37/126 R |
| 3,651,589 | 3/1972 | Reynolds | 37/129 |
| 4,015,348 | 4/1977 | Gee et al. | 37/129 X |

*Primary Examiner*—Dennis L. Taylor
*Assistant Examiner*—Arlen L. Olsen
*Attorney, Agent, or Firm*—Longacre & White

[57] ABSTRACT

An earth moving machine is adapted to be pulled behind a tractor or other powered vehicle. The earth moving machine comprises a hitch at a forward end thereof adapted to be connected to the tractor and an axle assembly at a rearward end thereof. A trough-shaped scoop is pivoted on a frame of the earth moving machine at a point intermediate the forward and rearward ends thereof. A first hydraulic cylinder assembly is operable to control the height of the axle assembly relative to the frame, while a second hydraulic cylinder assembly is operable to pivot the trough-shaped scoop relative to the frame. By controlling the fluid pressure supplied to the first and second hydraulic cylinder assemblies, the scoop on the earth moving machine can be used to effect scraping, levelling, digging, carrying, and dumping of dirt. When the scoop is pivoted to its scraping position, a blade provided on the scoop for selectively cutting into the ground surface is located at a position rearward of the pivot point of the scoop.

12 Claims, 3 Drawing Sheets

LAND ARRANGER

BACKGROUND OF THE INVENTION

I. Field of the Invention

This invention relates to earth moving equipment which is adapted to be hitched to and pulled behind a tractor. More specifically, the present invention relates to a tractor drawn land arranger having the capability to scrape, level, dig, and carry.

II. Description of the Prior Art

The prior art discloses several types of tractor drawn earth shaping machines. Examples of these machines are disclosed in U.S. Pat. Nos. 1,911,511 to Jordan, 2,483,033 to Baker, 3,110,972 to Waite, and 3,651,589 to Reynolds. The patent to Jordan discloses a tractor drawn device including a frame having a hydraulically actuated scoop operable to either scrape, scoop, or dump dirt. The problem associated with the Jordan device is that the scoop has a limited range of operation, and is forced to function in an inferior manner. Specifically, the Jordan scoop can only level dirt after it is itself full to the point of refusal. As such, the scoop unavoidably removes a substantial amount of dirt before scraping can occur. Such a system leads to problems during operation because it can become a guessing game as to when scraping, as opposed to scooping, will occur, and in some instances the scoop will merely become a heavy dragged object accomplishing neither scooping or scraping. Such guess work often leads to trial and error operation when using the device in unfamiliar soil, and can produce poor results.

The Baker device is a scoop adapted to be mounted on the front of an earth moving implement equipped with a blade. The blade is positioned so as to push dirt into the scoop for carrying and later deposition as desired. The scoop cooperates with the blade and tractor earth moving capability to add a dirt carrying capability previously not associated with the bulldozer.

The Waite device is a tractor drawn earth scooping and carrying device. The scoop includes a frontal shroud portion which prevents scooped earth from exiting the device while in the transport mode. Also, the scoop can be substantially tipped so as to empty the scoop. However, the Waite device is disadvantaged in a manner similar to the Jordan device in that simple scraping cannot be accomplished without some guess work. Instead of simply scraping and moving a layer of dirt in front of a blade, a certain amount of scooping and carrying may take place which will lessen the scraping effect of the blade.

The patent to Reynolds reveals a tractor drawn scraper wherein the angle of inclination of the bucket or scoop can be adjusted somewhat in order to spread dirt collected evenly and smoothly. However, the inventive hydraulic system in this patent is such that the bucket may only be lowered while it is in its horizontal or loading position. Consequently, it becomes difficult to perform controlled scraping and levelling without also scooping and collecting dirt in the bucket.

SUMMARY OF THE INVENTION

It is an object of the present invention to provide a earth moving machine of the kind adapted to be pulled behind a tractor which facilitates scraping, levelling, digging and carrying dirt and which is not characterized by the drawbacks of prior art devices.

It is a further object of the invention to provide an earth moving machine of simple and robust construction which may be easily controlled by an operator to efficiently perform any one of several earth moving functions.

Specifically, the invention comprises an earth moving machine adapted to be towed behind a powered vehicle having a horizontally extending frame member with a forward end and a rearward end. Hitch means are disposed at the forward end of the frame member and are adapted to be connected to the powered vehicle for permitting the earth moving machine to be pulled by the powered vehicle. A suspension member is connected to the frame member, and the suspension member has a displaceable portion which is movable relative to the frame at least in a vertical direction. A wheel assembly is secured to the displaceable portion of the suspension member, the wheel assembly having a plurality of wheels adapted to roll along a ground surface on which the earth moving machine travels.

The earth moving machine is further provided with a scoop having a pair of side plate sections rigidly joined to opposite ends of a trough-shaped section and defining a scoop opening. The scoop is pivotally mounted relative to the frame about a pivot location on the frame intermediate the forward and rearward ends thereof. The trough shaped section of the scoop comprises a scoop lip portion located adjacent the scoop opening to which at least one blade means is attached for selectively cutting into the ground surface.

The earth moving machine is provided with first and second motor means. The first motor means is used for controllably moving the displaceable portion of the suspension member relative to the frame member so as to controllably vary the vertical position of the displaceable portion relative to the frame member. Similarly, the second motor means is used for controllably pivoting the scoop relative to the frame so as to controllably vary the orientation of the scoop opening relative to the frame member. More specifically, the second motor means is operative to controllably pivot the scoop between a first and a second position. In the first position, the scoop is oriented such that the scoop opening faces generally upwards and the scoop is effective for carrying a load as the earth moving machine travels along the ground surface, while in the second position, the scoop is oriented such that blade means is positioned rearwardly of the pivot location of the scoop, whereby scraping and levelling of dirt is facilitated.

According to the invention, the earth moving machine includes a plurality of ripper means for breaking up the ground surface which are attached to the frame member and extend downwardly therefrom.

According to another aspect of the invention, the side plate sections are each provided with a reinforcement member, and the scoop is pivotally connected relative to the frame by means of a pair of pivot axles, each pivot axle being secured to the reinforcing member on a respective one of the side plate sections and being received within a complementary opening of the frame member.

In another aspect of the invention the trough shaped section is provided with a first reinforcing member which extends in an axial direction thereof and a second part-circular reinforcing member which extends along an outer circumference thereof. Moreover, the trough-shaped section defines a part-circular cylinder.

In a preferred embodiment of the invention, the first and second motor means comprise hydraulic cylinder assemblies. In conjunction with the hydraulic cylinder assemblies, means are provided for selectively securing a brace between a portion of the machine rigid with the wheel assembly and a portion of the machine rigid with the frame member, thereby relieving a force exerted on the hydraulic cylinder assembly of the first motor means when the hydraulic cylinder assembly of the first motor means is to be maintained in an extended position. Moreover, the earth moving machine includes hydraulic lines leading to the hydraulic cylinder assembly of the first motor means, the hydraulic lines being disposed at least partially within a hollow horizontal member which is located above the scoop and supported on the frame member, whereby the hydraulic lines leading to the hydraulic cylinder assembly of the first motor means are substantially protected during operation of the machine.

In yet another aspect of the invention, the second motor means comprises a pair of the hydraulic cylinder assemblies which are located on opposite sides of the scoop and which are each pivotally connected between the scoop and a frame support member secured to the frame member.

Moreover, according to the invention, pivot axle means are provided on each of the side plate sections for pivotally supporting the scoop relative to the frame member. When the scoop lip is substantially horizontal, a vertical distance from an uppermost portion of the scoop to the pivot axle means is at least three times as great as a vertical distance from the pivot axle means to a bottommost portion of the scoop.

Still another aspect of the invention is characterized in that the blade means comprises a double edged grader blade and the scoop lip portion comprises an angle-iron section to which the double edged grader blade is secured.

DETAILED DESCRIPTION OF THE PREFERRED EMBODIMENTS

Figure 1:
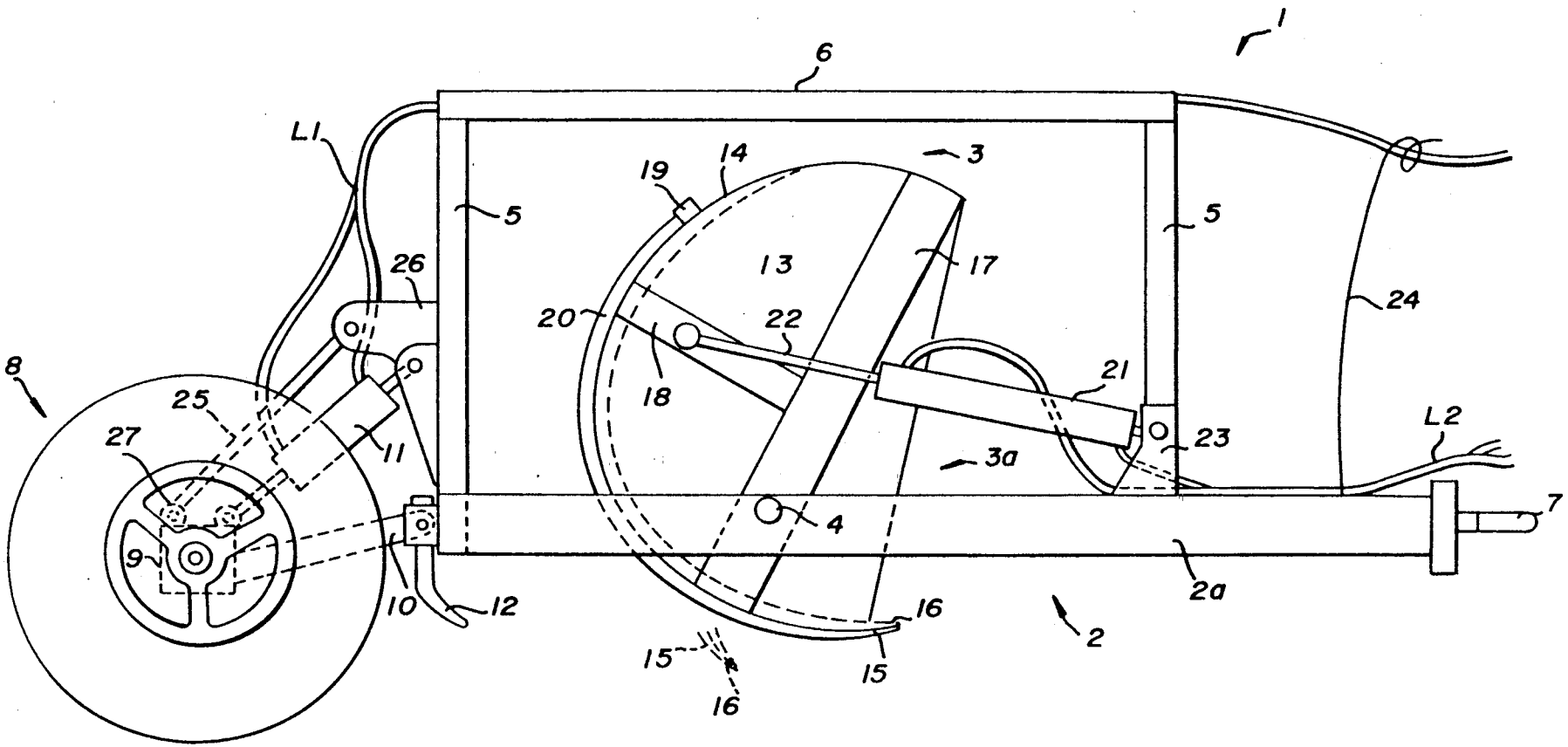
FIG. 1 reveals a side view of a land arranger according to the present invention.
Figure 2:
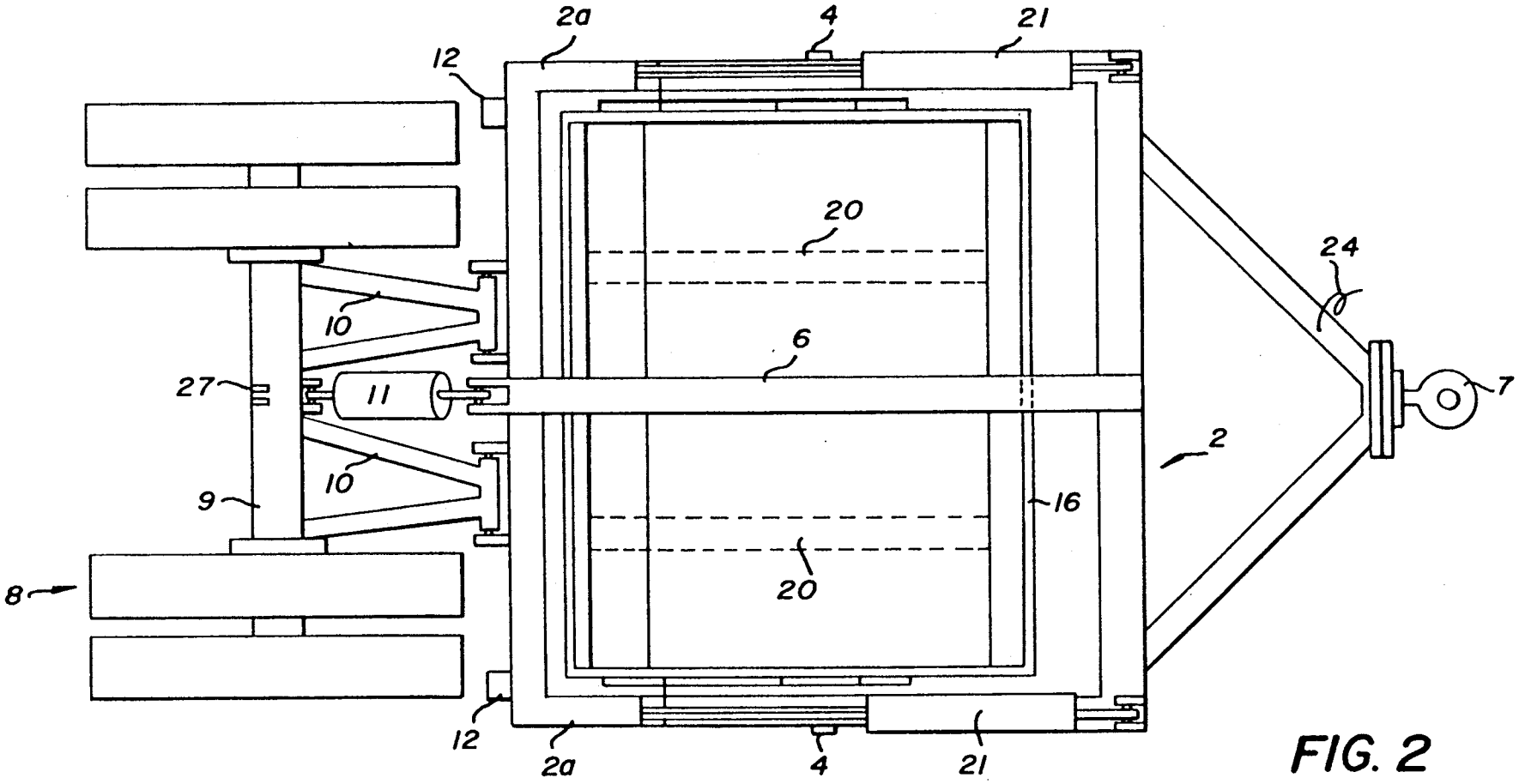
FIG. 2 reveals a top view of the land arranger shown in FIG. 1 when the drum-like scoop is in its loaded or travelling position.

Referring to FIGS. 1 and 2, there is shown a land arranger 1 comprising a frame 2 which supports a drum-like scoop 3 for pivotal movement about a pair of short pivot axles 4 which extend outwardly from the scoop 3 and are received in complementary openings provided within the frame 2. A pair of vertical support members 5 extend upwardly from the frame 2 and are joined together by a longitudinal member 6 so as to encompass at least the upper portion of the scoop 3. The frame 2 and the members 5, 6 each comprise e.g. box section steel.

The frame 2 is provided at its forward end with a hitch means 7 which is adapted to be connected to a tractor or other working vehicle for permitting the land arranger 1 to be towed. At its rearward end, the land arranger 1 is provided with a box beam axle 9 which carries a plurality of (e.g. four) wheels 8. The axle 9 is adjustably suspended from the frame 2 via a plurality of pivotable trailing arm suspension members 10 and a first hydraulic cylinder assembly 11. The first hydraulic cylinder assembly 11 is pivotally connected to both an outer casing portion of the axle 9 and a suitable non-pivoting portion of the land arranger 1 (such as a bracket secured to the rear vertical member 5). A plurality of adjustable land rippers 12 (the purpose of which will be described hereinafter) extend downwardly from the rearward end of the frame 2. (The distance which the rippers 12 extend downwardly from the frame 2 is, in the preferred embodiment, manually adjustable both side to side and up and down along the frame 2 by means of selectively positioned locking bolts or hydraulic actuators, not shown. The number of rippers and their particular location along the frame is optional.)

The scoop 3 specifically comprises a pair of substantially part-circular side plates 13 which are joined (e.g. by welding) to opposite axial ends of a trough shaped, substantially half-circular cylindrical member 14. As shown in the Figure, the diameter of the side plates is substantially equal to the diameter of the half-cylindrical member. The pair of side plates are, however, angularly offset relative to and about the axis of the half cylindrical member in the clockwise direction, thereby producing a scoop lip 15 at one circumferential end of the half-cylindrical member to which a transverse blade 16 (e.g. made from hardened steel) is attached. A scoop opening **3*a* is formed above the lip 15 and between the side plates 13, through which dirt (or any other material) may be loaded into the half-cylindrical member 14**.

Each of the part-circular side plates 13 are reinforced by a pair of steel reinforcing members 17, 18. The reinforcing member 17 is secured along a diameter of the side plate 13 while the reinforcing member 18 is secured to the side plate 13 substantially perpendicularly to the member 17. (The pivot axles 4 on either side of the scoop 3 are rigidly secured to the reinforcing members 17. When the scoop is pivoted such that the reinforcing member 17 is oriented vertically, the scoop 15 is substantially horizontal, and that the blade 16 occupies a position forward of the pivot axles 4 and beneath the frame 2, a vertical distance from the top of the scoop to the center of the pivot axle is preferably greater than or equal to three or four times the vertical distance from the center of the pivot axle to the bottom of the scoop.) The half-cylindrical member is reinforced by at least one transverse member 19 which secured thereto along an axial (i.e. transverse relative to the travelling direction of the land arranger) length thereof. Additional reinforcement for the half-cylindrical member 14 is provided by a pair of part-circular support members 20 which are secured along the outside circumference of the scoop 3 at axially spaced locations.

The angular position of the scoop 3 is controlled by means of a pair of second hydraulic cylinder assemblies 21 located on opposite sides of the scoop 3, each of which comprises a cylinder end pivoted to a frame support member 23 and a piston rod end 22 pivoted to the reinforcing member 18. Each frame support member 23 is secured (e.g. by welding) one of the side bars **2*a* of the frame 2. In a preferred embodiment, each of the hydraulic cylinder assemblies 21 and the frame support members 23 may be shrouded by a cover C secured to the respective side bar 2*a*, as shown by dotted lines in FIG. 1, to protect the cylinder assemblies 21** from falling dirt, rocks, etc. during operation of the land arranger.

The first and second hydraulic cylinder assemblies are independently connected to a convenient source of hydraulic power (e.g. the existing hydraulic system of the tractor) via hydraulic lines L1 and L2, respectively. As seen in FIG. 1, the hydraulic lines L1 extend from opposite ends of the first cylinder assembly 11, through the longitudinal member 6, through an intermediate support 24 (e.g. made from a steel rod extending from the frame 2 and having a bent to present a spiral shape at its free end for receiving the lines L1, as shown), and forwardly of the land arranger 1 to the source of hydraulic power. In operation, a hydraulic pressure supplied to a cylinder end of the hydraulic cylinder assembly 11 through one of the lines L1 will cause an extension of the hydraulic cylinder assembly, while a hydraulic pressure supplied to a piston rod end of the hydraulic cylinder assembly 11 through the other of the links L1 will cause the same to retract. The hydraulic lines L2 extend from opposite ends of the second cylinder assemblies 21, along the frame 2, and forwardly of the land arranger to the source of hydraulic power. Hydraulic pressure applied to the second cylinder assemblies cause the same to extend and retract in a manner similar to that described above with reference to the first hydraulic cylinder assembly 11. A hydraulic control system (not shown) is employed to independently control the amount of hydraulic pressure in each of the lines L1, L2, as will be explained hereinafter. A suitable source of and control of hydraulic pressure can be a conventional hydraulic equipment actuator found on most tractors outfitted for hydraulic equipment operation.

Figure 3:
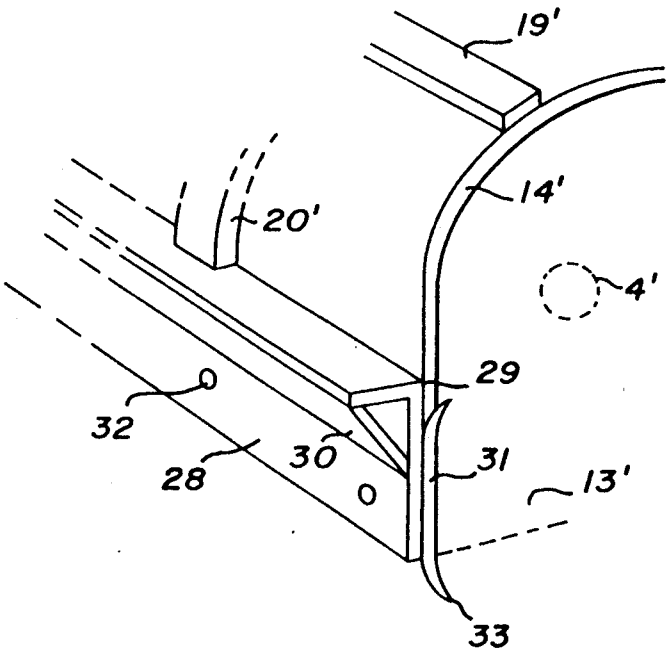
FIG. 3 reveals a detailed perspective view of a preferred embodiment of the drum-like scoop.

FIG. 3 reveals a presently preferred manner of connecting the blade of the land arranger to the scoop As shown in the Figure, reinforcement members 19',20' are provided on the substantially half-circular cylindrical member 14' in the manner described with reference to the members 19, 20 above. Moreover an angle-iron 28 is secured (e.g. by welding) to the half-cylindrical member 14' at a horizontal marginal area 29 of the member 14'. The angle-iron 28 defines a scoop lip and is itself reinforced by a steel brace 30 secured thereto (e.g. by welding. Moreover, the angle-iron 28 butts against end portions of the reinforcement members 20', whereby the structural rigidity of the angle-iron relative to the member 14' is ensured. A double edged grader blade 31 is releasably secured (e.g. by bolts, rivets, fasteners, etc. as shown at 32) to the angle-iron 28 in such a manner that a downwardly depending edge 33 of the grader blade 31 extends about two inches below the lowermost portion of the angle-iron 28. As shown in the Figure, the side plates 13' and pivot axles 4' are located in substantially the same locations and orientations as described above with reference to the side plates and pivot axles 13, 4 shown in FIGS. 1 and 2. Consequently, according to the invention, when the scoop of FIG. 3 is employed in the land arranger, its blade tip 33 occupies the same positions as shown and described with reference to the blade 16 in FIGS. 1 and 2. The blade may also be equipped with rippers on a leading edge thereof, i.e., in a manner similar to conventional front end loaders or bull dozers, so that ripping can be accomplished when the blade is positioned in the scraping position.

In operation, the land arranger 1 is attached to a source of motive power (such as a tractor) via the hitch means 7. The hydraulic lines L1, L2 are connected to a source of hydraulic power through the hydraulic control system. The hydraulic control system, which is conveniently operated (e.g. via a control panel) by the operator of the motive power source, is used to selectively and independently control the magnitude of hydraulic pressure in the lines L1 and L2 to produce the various modes of operation explained below.

The field travelling mode is used when it is necessary to pull the land arranger 1 from one field location to another. In this mode, a hydraulic pressure is supplied to the lines L1 and L2 so as to cause the cylinder assemblies 11 and 21 to assume their extended positions. The extension of the first hydraulic cylinder assembly 11 causes the trailing arms 10 to rotate (e.g. through an acute angle) in a counterclockwise direction, thus raising the rear end of the frame 2 higher off the ground. This provides a travelling clearance between e.g. the rippers 12, the scoop 3, etc. and the ground. The extension of the second hydraulic cylinders 21 causes the scoop to rotate (e.g. pivot about the axle 4) in a counterclockwise direction. When the second hydraulic cylinder 21 is extended, the opening 3a of the scoop 3 faces generally upwardly. The counterclockwise rotation of the scoop 3 is effective to prevent dirt which may have been accumulated in the scoop 3 from falling out of the scoop when the land arranger is being towed or transported. Once the cylinders 11, 21 have been extended, it is possible to cut off hydraulic communication between the pressure source and the lines L1, L2 (e.g. through the use of conventional cut-off valves), thereby isolating the cylinders 11, 21 from the hydraulic source and maintaining the cylinders 11, 21 in their extended positions. This eliminates the need for continually supplying a high hydraulic pressure to the lines L1, L2 during the field travelling mode. Moreover, once the cylinders have become extended, it is possible to employ a structural brace, such as shown at 25 in FIG. 1, disposed in parallel with the hydraulic cylinders, to remove the operating load from the hydraulic cylinders. In particularly, after the cylinder 11 has been extended, the brace 25 is inserted and secured between the flanges 26 on the rearward vertical support member 5 and flanges 27 (note FIG. 2) on a rearward portion of the box beam axle 9. The brace 25 is thus employed e.g. when travelling long distances to relieve the extended hydraulic cylinder 11 its entire operating load, thereby increasing the durability and reliability of the hydraulic system.

In the leveling or scraping mode, a hydraulic pressure is supplied to the lines L2 so as to cause the second hydraulic cylinders 21 to assume their fully retracted position. The retraction of the piston rods 22 causes the scoop 3 to rotate (e.g. pivot) in the clockwise direction about the axle 4. After the clockwise rotation of the scoop 3, the scoop lip 15 will be oriented at the bottom rear portion of the scoop 3 (relative to the travelling direction of the land arranger 1) and blade 16 (or the blade tip 33 shown in FIG. 3) will point in a downward direction. Once the hydraulic cylinders 21 are retracted, the hydraulic pressure to the hydraulic cylinder 11 is controlled so as to (at least partially) retract the hydraulic cylinder 11. This retraction of the hydraulic cylinder 11 causes the trailing arms 10 to pivot clockwise, thereby reducing (and eliminating) the clearance between the blade 16 and the ground. Further retraction of the hydraulic cylinder 11 causes the blade 16 to dig into the ground, thereby determining a depth of scraping of the blade 16 when the land arranger is towed. Specifically, the hydraulic pressure to the first hydraulic cylinder 11 is precisely controlled so as to effect an optimum retraction of the cylinder 11, thereby producing the desired depth of cut in the scraping operation.

Moreover, because the scoop 3 is oriented such that the blade 16 is positioned at a bottom and rearward position thereof relative to the direction of travel, most of the dirt displaced by the blade 16 will merely be pushed by the scoop 3 during a leveling or scraping operation, and only a minimal amount of dirt will be collected within the scoop 3. This facilitates the leveling operation because the operator of the land arranger 1 need not be concerned with collecting too much dirt within the scoop. According to the invention, when the second hydraulic cylinders are fully retracted and the scoop 3 has been rotated (e.g. pivoted) clockwise to its leveling or scraping position, the blade 16 (or alternately, the blade tip 31) is disposed rearwardly of the axle 4 relative to the travelling direction of the land arranger, as shown partially in phantom lines in FIG. 1.

In the dirt carrying mode, the first hydraulic cylinder 11 is initially extended while the second hydraulic cylinder 21 is initially retracted. Next, when the land arranger 1 is travelling over an area in which it is desired to pick up or scrape up dirt from, the first hydraulic cylinder 11 is retracted so that the blade 16 scrapes the ground to a desired depth of cut. As the scraped dirt begins to enter the scoop, the hydraulic pressure to the second hydraulic cylinders 21 is controlled to gradually extend the second hydraulic cylinders, thereby allowing more dirt to be collected within the scoop 3. (As the second hydraulic cylinders are gradually extended, if desired, the hydraulic pressure to the first hydraulic cylinder 11 may be continually adjusted to vary the depth of out of the blade 16 so as to produce the largest possible load of dirt within the scoop 3 within the least amount of time.) Once the scoop 3 is substantially filled, the hydraulic pressure in the lines L1, L2 is controlled so as to fully extend the first and second hydraulic cylinders 11 and 21. Thus the scraping operation is terminated and the land arranger 1, with its scoop 3 substantially filled with dirt, enters the travelling mode. When the land arranger 1 arrives at a location where it is desired to unload the collected dirt, the dirt may be easily unloaded merely by supplying a hydraulic pressure to the lines L2 which causes the second hydraulic cylinders 21 to retract smoothly, thereby rotating the scoop 3 in a clockwise direction. As the scoop rotates in the clockwise direction, the collected dirt falls to the ground through the scoop opening 3*a* in a controlled and even manner, thereby emptying the scoop.

The ripping mode is used when it is necessary to rip up hard or dry ground e.g. before levelling or scraping can take place. In this mode, the rippers 12 are caused to dig into the ground as the land arranger 1 is travelling. Specifically, the vertical position of the rippers relative to the frame 2 is adjusted (if necessary) before entering the field travelling mode. Once the field travelling mode has been established, the hydraulic pressure in the lines L1 is adjusted to retract the hydraulic cylinder 11 and lower the rear end of the frame 2 relative to the ground until the rippers dig into the ground a desired amount. In this condition, as the land arranger 1 is towed, the rippers 2 will continually act so as to break up the dry and hard ground. Alternately, the ripping mode may be employed in conjunction with other modes of operation of the land arranger 1. For example, the rippers 12 may be used effectively when scraping up dirt in the dirt carrying mode for the purpose of loosening up dirt which is going to be scraped up in the next pass of the land arranger 1.

Although the embodiment shown in the Figures has been described as comprising hydraulic cylinder assemblies for pivoting the scoop 3 and the trailing arms 10, it will be understood that other kinds of motor devices (e.g. pneumatic, electric, etc.) may be used instead of the hydraulic cylinder assemblies, if desired.

While the present invention has been described with certain particularity, it is not meant to be limited to the disclosed embodiment. Those skilled in the art will be aware of numerous modifications which can be made to disclosed embodiment. Therefore, the present invention will encompass the disclosed embodiment and any modifications thereof which will fall within the scope of the appended claims.

I claim:

1. An earth moving machine adapted to be towed behind a powered vehicle, comprising:

a frame member comprising a forward end and a rearward end;

hitch means disposed at the forward end of the frame member and adapted to be connected to the powered vehicle for permitting the earth moving machine to be pulled by the powered vehicle;

a suspension member connected to the frame member, the suspension member having a displaceable portion which is movable relative to the frame at least in a vertical direction;

a wheel assembly secured to the displaceable portion of the suspension member, the wheel assembly comprising a plurality of wheels adapted to roll along a ground surface on which the earth moving machine travels;

a scoop comprising a pair of side plate sections rigidly joined to opposite ends of a trough-shaped section and defining a scoop opening, the scoop being pivotally mounted relative to the frame about a pivot location on the frame intermediate the forward and rearward ends thereof, wherein the trough shaped section comprises a scoop lip portion located adjacent the scoop opening to which at least one blade means is attached for selectively cutting into the ground surface;

a first motor means for controllably moving the displaceable portion of the suspension member relative to the frame member so as to controllably vary the vertical position of the displaceable portion relative to the frame member the first motor means being connected to the frame member at a position rearward of the scoop; and a second motor means for controllably pivoting the scoop relative to the frame so as to controllably vary the orientation of the scoop opening relative to the frame member, the second motor means being operative to controllably pivot the scoop between a first and a second position, wherein in the first position, the scoop is oriented such that the scoop opening faces generally upwards and the scoop is effective for carrying a load as the earth moving machine travels along the ground surface, and in the second position, the scoop is oriented such that blade means is positioned rearwardly of the pivot location of the scoop and the scoop is effective for facilitating scraping and levelling of dirt.

2. An earth moving machine as recited in claim 1, wherein a plurality of ripper means for breaking up the ground surface are attached to the frame member and extend downwardly therefrom.

3. An earth moving machine as recited in claim 1, wherein the side plate sections are each provided with a reinforcement member, and wherein the scoop is pivotally connected relative to the frame by means of a pair of pivot axles, each pivot axle being secured to the reinforcing member on a respective one of the side plate sections and being received within a complementary opening of the frame member.

4. An earth moving machine as recited in claim 1, wherein the trough-shaped section is provided with a first reinforcing member which extends in an axial direction thereof and a second part-circular reinforcing member which extends along an outer circumference thereof.

5. An earth moving machine as recited in claim 1, wherein the trough-shaped section defines a part-circular cylinder.

6. An earth moving machine as recited in claim 1, wherein the first and second motor means comprise hydraulic cylinder assemblies.

7. An earth moving machine as recited in claim 6, wherein means are provided for selectively securing a brace between a portion of the machine rigid with the wheel assembly and a portion of the machine rigid with the frame member, thereby relieving a force exerted on the hydraulic cylinder assembly of the first motor means when the hydraulic cylinder assembly of the first motor means is to be maintained in an extended position.

8. An earth moving machine as recited in claim 6, further comprising hydraulic lines leading to the hydraulic cylinder assembly of the first motor means, the hydraulic lines being disposed at least partially within a hollow horizontal member which is located above the scoop and supported on the frame member, whereby the hydraulic lines leading to the hydraulic cylinder assembly of the first motor means are substantially protected during operation of the machine.

9. An earth moving machine as recited in claim 6, wherein the second motor means comprises a pair of the hydraulic cylinder assemblies which are located on opposite sides of the scoop and which are each pivotally connected between the scoop and a frame support member secured to the frame member.

10. An earth moving machine as recited in claim 1, wherein pivot axle means are provided on each of the side plate sections for pivotally supporting the scoop relative to the frame member, and wherein, when the scoop lip is substantially horizontal, a vertical distance from an uppermost portion of the scoop to the pivot axle means is at least three times as great as a vertical distance from the pivot axle means to a bottommost portion of the scoop.

11. An earth moving machine as recited in claim 1, wherein the blade means comprises a double edged grader blade.

12. An earth moving machine as recited in claim 11, wherein the scoop lip portion comprises an angle-iron section to which the double edged grader blade is secured.

* * * * *